United States Patent [19]

Sullivan et al.

[11] 4,278,709

[45] Jul. 14, 1981

[54] METHOD OF APPLYING WATER SOLUBLE INTERNAL COATING TO HOT CANS

[75] Inventors: Richard W. Sullivan, Denver; Robert N. Warwick, Arvada, both of Colo.

[73] Assignee: Ball Corporation, Muncie, Ind.

[21] Appl. No.: 88,228

[22] Filed: Oct. 25, 1979

[51] Int. Cl.[3] ..... B05D 7/22

[52] U.S. Cl. ..... 427/233; 427/240

[58] Field of Search ..... 427/233, 240

[56] References Cited

U.S. PATENT DOCUMENTS 3,693,828 9/1972 Kneusel et al. ..... 220/70 X 4,186,225 1/1980 Smith et al. ..... 427/233

*Primary Examiner*—James R. Hoffman

*Attorney, Agent, or Firm*—Nicholas T. Bokides

[57] ABSTRACT

A method of applying a water soluble epoxy resin to the interior surface of a heated beverage can of the light-weight design is disclosed. The epoxy, in a low viscosity solution, is directed against the interior surface of the can while the can is rotated. Centrifugal forces act on the epoxy solution causing a flow of the solution from the center portion of the can bottom to the difficult to access inner frustoconical surfaces.

3 Claims, 1 Drawing Figure

METHOD OF APPLYING WATER SOLUBLE INTERNAL COATING TO HOT CANS

BACKGROUND OF THE INVENTION

This invention relates to the manufacturing of cans and more particularly, to the application of a water soluble epoxy coating to the interior of a heated can.

Metal containers have long been used in the beverage industry as a convenient packaging means. Before a can is suitable for containment of a beverage it is necessary to coat the interior surface with a protective substance to prevent the contamination of the beverage with a metallic taste. This coating is generally applied by a single nozzle positioned off the can center and outside the can. A narrow fan of spray is directed across the can to impinge on a thin strip of the interior surface along the entire length of the sidewall and a portion of the bottom. The can is then rotated thereby depositing a coating of between about 1 and 3 ten-thousandths of an inch thick, when cured, upon the entire interior surface.

Recently a new design of a light-weight can has been developed and gained acceptance in the beverage industry. This can has an integral bottom which comprises an outer frustoconical surface extending downwardly and inwardly from the sidewalls, an annular bead for supporting the can, an inner frustoconical surface extending upwardly and inwardly from the annular supporting bead, and a recessed domed center panel extending inwardly and upwardly along the axis of the can from the inner frustoconical surface. The combination of the above elements in a number of different designs has allowed the use of thinner metal in the can, thereby reducing the cost, while preserving the resistance to eversion necessary in a container which will be subjected to pressures of up to 100 psi.

Because of the particular design configurations of the can bottoms, there are numerous difficulties in adequately coating them, and especially the inner frustoconical surfaces therein. For stability purposes the annular bead which supports the can has a radius of over 80% of the total can radius. The inner frustoconical surface begins at the annular bead and extends upwardly and inwardly at an angle of between 0 degrees and about 30 degrees with the longitudinal axis of the can. As this surface faces away from the can center and is near the sidewall, it is highly inaccessible to a coating material directed from outside the can. In fact, where a single spray nozzle is positioned off the can center and directed across the can, depending on the exact position of the nozzle and shape of the surface, it often is found that it is geometrically impossible to directly spray the inner frustoconical surfaces. At best, a very small area of this surface is in the direct path of the spray pattern.

U.S. Pat. No. 3,693,828 to Kneusel, et. al., teaches a method of spraying difficult to reach surfaces by employing two nozzle spray devices.

When cans are treated with a solvent based epoxy or when cans at room or ambient temperatures are treated with a water base epoxy, the inability to directly spray the inner frustoconical surfaces is not a serious drawback. Apparently a sufficient amount of coating material is deposited on this surface by mere deflection off the sidewall of the can. But where cans substantially above ambient temperature are being sprayed with a water soluble epoxy, difficulties are generally encountered in achieving an acceptable coating on the inner frustoconical surfaces.

Hot cans are commonly encountered because the interior of cans are treated directly after a decorative coating has been applied to the exterior surface and cured. Cans emerge from this curing step at temperatures in excess of 200 degrees F. Although some cooling occurs as the can is transported to the interior coating operation, it is not unusual for a can to enter the interior coating process at a temperature in excess of 160 degrees F. depending on the ambient temperature in the manufacturing plant.

For proper adhesion of water soluble epoxies to the can surface it is important that a relatively slow curing process take place. During the curing process the carrier is evaporated while the solid material is left in a near liquid state. Upon cooling, the solid material strongly adheres to the can surface.

When a can having a temperature above 140 degrees F. is encountered in the treating process flash evaporation of the carrier may occur resulting in improper curing and a poor bond between the coating material and the can surface. Surprisingly this does not prevent proper coating of the can surface in areas where the coating material is directly sprayed onto the can. Apparently flash evaporation only occurs to the initial droplets of material reaching the can thereby cooling the surface and leaving a sufficient deposit of carrier on the surface to allow proper curing. This is not true of the inner frustoconical surfaces which receive the coating material indirectly by deflection off the sidewalls. The combination of the coating being preheated by contact with the sidewall and the lessor amount of coating which is finally deposited on the frustoconical surface results in total evaporation of the carrier prior to curing rendering the coating defective.

Therefore, it is necessary to take corrective cooling action if a water soluble epoxy is to be used for the coating material. Cooling is usually accomplished by increasing the time between curing the exterior coating and treating the interior. This requires more trackwork to give the cans an extra 1 to 2 minute ride or an accumulator to store cans for 1 to 2 minutes. Both methods are undesirable in that space and trackwork are wasted and more importantly, an increase in the handling of the cans is required resulting in a greater risk of damage to the cans.

SUMMARY OF THE INVENTION

Accordingly it is an object of this invention to provide an effective method of coating the inner frustoconical surfaces of hot metal cans.

It is another object of this invention to eliminate the need to cool light-weight cans prior to applying an internal coating, especially those coating materials comprising water soluble epoxy resins.

It is another object of this invention to eliminate the extra trackwork, accumulating devices and other means used for cooling cans prior to applying an internal coating to said cans.

It is still another object of this invention to provide a method of coating an inaccessible surface which is integrally connected to a substantially planar surface which is accessible.

In accordance with these objects, an extremely low viscosity water soluble epoxy solution is directed to the interior of a rapidly rotating can while said can is at a temperature in excess of ambient temperature. Herein, the term in excess of ambient temperature means those temperatures generally in excess of 140 degrees F.

A sufficiently broad spray pattern is necessary to apply the epoxy solution to a thin strip of the interior surfaces beginning at the terminal edge of the sidewall, extending downward to the can bottom and therebeyond across said can bottom to a distance including the can radius. A greater amount of solution should be applied to the bottom than would be necessary for treating a can at ambient temperature.

Some solution will be deposited onto the inner frustoconical surface by deflection off the sidewalls of the can. Immediate flash evaporation of the carrier will occur and cool this surface. The centrifugal forces established in the epoxy solution on the domed center panel of the can will cause a flow of this solution outwardly along the bottom and over the inner frustoconical surface. This coating solution will rewet and repair areas where flash evaporation has occurred. A sufficient amount of solution will thereby be applied to the inner frustoconical surface to allow proper curing of the coating.

BRIEF DESCRIPTION OF THE DRAWING

The FIGURE is a cross-sectional view of a conventional spraying device positioned above a light-weight can.

DETAILED DESCRIPTION OF THE INVENTION

Figure 1:
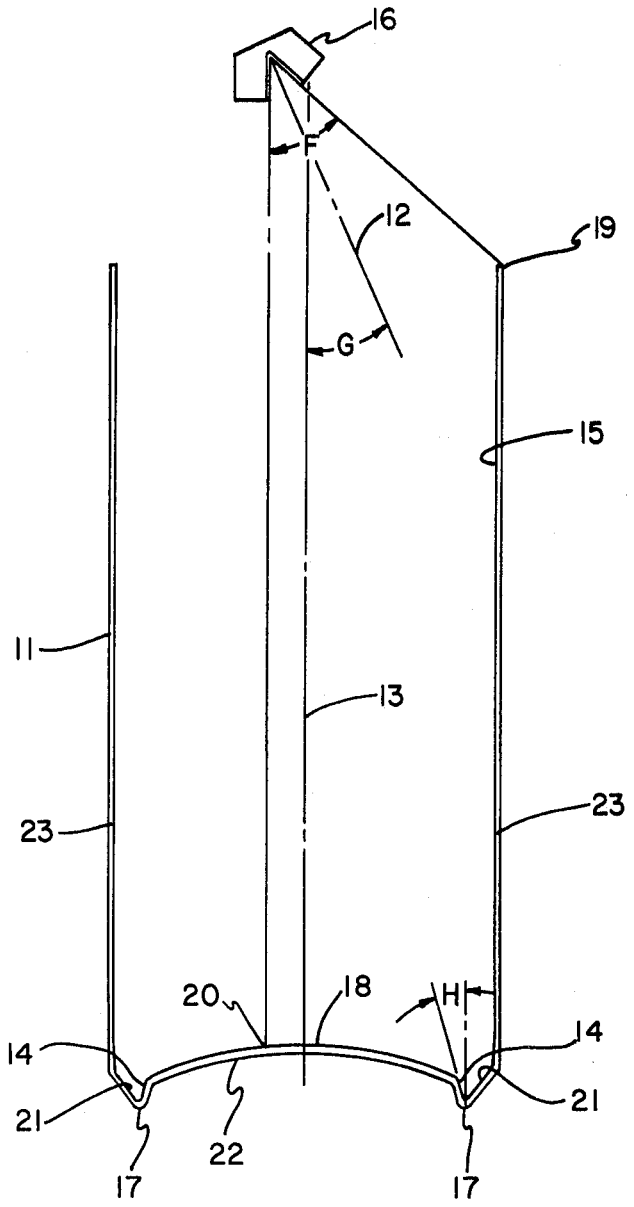

In the FIGURE, the spraying device 16 emits a uniform spray of coating solution at an angle of dispersion f, into rotating can 11. Can 11 has sidewall 23 and an integral bottom 22. The bottom has an outer frustoconical surface 21, beginning at sidewall 23, and extending downwardly and inwardly to annular bead 17. Inner frustoconical surface 14 begins at annular bead 17 and extends upwardly and inwardly at angle h, with longitudinal axis 13 to domed center panel 18.

Spraying device 16 directs coating solution onto a thin strip of the interior surface of can 11 between outer points 19 and 20. The almost imperceptible coating solution deposited on the interior surface is referenced by number 15. Point 19 is at the terminal edge of sidewall 23. For practical reasons it is impossible to precisely confine the spray to point 19, so often some spray will be directed above sidewall 23, missing the interior of the can, to ensure the terminal edge is covered. The outer outermost point of coverage, point 20, must be on the left side of where longitudinal axis 13 intersects domed center panel 18. If point 20 is contemporaneous with where longitudinal axis 13 intersects panel 18, a minimum amount of coating will be deposited on the panel. As point 20 is moved to the left, an overlap in spray is achieved on panel 18 due to the rotating can.

Any conventional spraying means having the necessary spray pattern breadth may be used. Satisfactory results have been obtained with Tungston Carbide flat spray tips number 400025 manufactured by Spraying Systems Company when run at a pressure of between 800 and 900 psi. This tip has a 40 degree dispersion angle with an essentially flat fan-like spray pattern.

It will be noted that construct 12 bisects angle of dispersion f, and forms and angle g, with the longitudinal axis. By decreasing angle g, outermost point of coverage 20 is moved to the left and a greater amount of solution will be deposited on domed center panel 18.

It has been found that when using a spray head with an angle of dispersion of about 40 degrees, angle g should be between 16 and 25 degrees when spraying a cold can. Where the present invention is employed using a low viscosity solution, angles between 12 and 18 degrees have been found to yield the best results.

Upon spraying a can heated to above ambient temperature, some solution will be deposited on inner frustoconical surface 14, by deflection off sidewall 23. Flash evaporation will occur resulting in improper curing and an unacceptable coating. Centrifugal forces set up in the solution on domed center panel 18 will cause a flow of the solution outwardly along said panel and over inner frustoconical surface 14, thereby depositing a sufficient amount of solution on surface 14 to allow proper curing.

It should be noted that where the can is being sprayed in an upright position, gravity as well as centrifugal forces will act on the solution on domed central panel 18 causing a flow of said solution toward and over inner frustoconical surface 14.

Curing of the coating is usually accomplished by exposing the can to air heated to a temperature of between 350 and 400 degrees F. for 30 to 60 seconds.

The term water soluble epoxies includes solutions, emulsions, as well as dispersions. In general the epoxy resins may be made by the reaction of epichlorohydrin with bisphenol A. Aliphatic polyols such as glycerol may be used instead of the aromatic bisphenol A. The resin may also be made by reactions of polyolefins oxidized with peracetic acid. These resins are further rendered water soluble by incorporation of modifying moieties and include polyvinyl alcohols, polyvinyl pyrrolidone and polethyleneimine. These resins, when purchased commercially in solution form, generally have a viscosity of between 30 and 50 seconds when measured in a number 4 Ford cup at 77 degrees F. It is necessary to substantially lower the viscosity of these resins to below 22 seconds for good results. Typically, the viscosity may be lowered to the desired range by adding water. It is also often possible to special order these resins, such as Glidden Formula 640-C-552, by specifically requesting the viscosity wanted.

What is claimed is:

1. In a method for applying an internal coating to a hot light-weight can having an inner frustoconical surface at an angle of between 0 and 30 degrees, comprising the steps of, rotating said can, directing a coating composition onto the interior surface of said can, and curing said coating composition on said interior surface, wherein the improvement comprises, directing a composition including water and epoxy onto the interior surface of the can wherein said composition has a viscosity of between 22 and 16 seconds when measured at 77 degrees F., in a number 4 Ford cup and wherein said can has a temperature of over 140 degrees F., and the additional step of allowing said coating composition to flow outwardly along the bottom of said can thereby coating the inner frustoconical surface, said allowing step to be performed prior to said curing step.

2. A method for applying an internal protective coating in one spraying operation, to a lightweight can having an inner frustoconical surface which extends upward and inward at an angle of between 0 and 30 degrees, comprising the steps of, heating the can to above 140 degrees F., providing a spray tip having about a 40 degree dispersion angle with an essentially flat dispersion pattern, orienting said spray tip such that it is at an angle of between about 12 and 18 degrees with the longitudinal axis of the can and such that said 40 degree angle of dispersion will cover a thin strip of the interior of the can extending from the terminal edge of th sidewall to at least where the longitudinal axis of the can intersects the domed panel, depositing sufficient material on the can for a satisfactory coating by the step consisting of directing a composition including epoxy and water toward the interior of the can through said spray tip, said composition having a viscosity of between about 18 and 22 seconds when measured in a number 4 Ford cup at 77 degrees F., rapidly rotating the can, allowing said composition to flow outwardly along the bottom of said can over the inner frustoconical surface, and curing said composition.

3. The method of claim 1 or 2 wherein said epoxy is a reaction product of epichlorohydrin with bisphenol or an aliphatic polyol with a member selected from the group consisting of polyvinyl alcohol, polyvinyl pyrrolidone and polyethyleneimine.

* * * * *